US010966477B2

(12) United States Patent
Baker

(10) Patent No.: US 10,966,477 B2
(45) Date of Patent: Apr. 6, 2021

(54) JACKET WITH GRADUATED TEMPERATURE REGULATION

(71) Applicant: Wolverine Outdoors, Inc., Rockford, MI (US)

(72) Inventor: Neil Baker, Portland, OR (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 16/180,716

(22) Filed: Nov. 5, 2018

(65) Prior Publication Data

US 2020/0138134 A1 May 7, 2020

(51) Int. Cl.

| | |
|---|---|
| ***A41D 27/28*** | (2006.01) |
| ***A41D 3/02*** | (2006.01) |
| ***A41D 27/24*** | (2006.01) |

(52) U.S. Cl.

CPC ..... *A41D 27/28* (2013.01); *A41D 3/02* (2013.01); *A41D 27/24* (2013.01); *A41D 2300/50* (2013.01)

(58) Field of Classification Search

CPC ..... A41D 27/24; A41D 27/28; A41D 3/02; A41D 2300/50; A41D 3/00; A41D 31/145; A41D 31/065

See application file for complete search history.

(56) References Cited

U.S. PATENT DOCUMENTS

| | | | | | |
|---|---|---|---|---|---|
| 429,894 | A | * | 6/1890 | Doremus | A47G 9/0207 5/502 |
| 1,139,642 | A | * | 5/1915 | Cox | A41D 29/00 2/1 |
| 1,345,046 | A | * | 6/1920 | Wedlock | A41D 31/06 112/417 |
| D59,177 | S | * | 10/1921 | Biva | D5/52 |
| 1,754,342 | A | * | 4/1930 | Tubiolo | B63C 9/1255 441/112 |
| 1,893,548 | A | * | 1/1933 | Hardy | A47G 9/086 5/502 |

(Continued)

FOREIGN PATENT DOCUMENTS

| | | |
|---|---|---|
| WO | 2009012476 | 1/2009 |
| WO | 2017062539 | 4/2017 |

*Primary Examiner* — Jocelyn Bravo

(74) *Attorney, Agent, or Firm* — Warner Norcross + Judd LLP

(57) ABSTRACT

A puffer jacket configured to provide improved temperature regulation through graduated venting. In one embodiment, the jacket includes a back panel with baffles and insulation arranged to provide reduced insulation and increased venting of heat and humidity toward the center of the back. The back panel may include an alternating arrangement of insulation baffles (containing insulation) and vent baffles (free of insulation). The insulation baffles and vent baffles may be formed by joining inner and outer layers of fabric with laterally extending lines of stitching. The lines of stitching may follow paths selected to progressively change the relative size of the vent baffles and the insulation baffles toward the center of the back. For example, the lines of stitching may give the insulation baffles a somewhat hourglass shape shortening toward the center of the back resulting in increasingly greater venting of heat and humidity toward the center of the back.

17 Claims, 11 Drawing Sheets

(56) References Cited

U.S. PATENT DOCUMENTS 2,222,782 A * 11/1940 Moses ..... A47C 31/105 5/500
2,248,768 A * 7/1941 Licht ..... A47G 9/0207 5/485
2,350,363 A * 6/1944 Massa ..... A47G 9/0207 428/108
2,466,911 A * 4/1949 Raymond ..... A41D 27/28 428/131
2,730,721 A * 1/1956 Van Veen ..... A47G 9/086 5/413 R
2,831,198 A * 4/1958 Datlof ..... B65H 54/24 2/458
2,851,390 A * 9/1958 Chavannes ..... A41D 31/02 428/137
3,162,489 A * 12/1964 Trotman ..... A47C 7/74 297/452.45
3,405,674 A * 10/1968 Coates ..... D04H 1/4374 112/420
3,482,567 A * 12/1969 Franklin ..... A61B 46/40 128/849
3,577,305 A * 5/1971 Hines et al. ..... A41D 13/0155 428/72
3,639,931 A * 2/1972 McGuire ..... A47G 9/086 5/413 R
3,771,170 A * 11/1973 Leon ..... A41D 13/0155 2/97
3,856,598 A * 12/1974 Gregorian ..... D04H 11/00 156/85
3,950,789 A * 4/1976 Konz ..... A41D 13/0055 2/93
3,959,834 A * 6/1976 Hunt ..... A47G 9/086 5/413 R
4,048,675 A * 9/1977 Griffin ..... A41D 3/00 2/93
4,115,610 A * 9/1978 Wortman ..... A47G 9/0207 112/420
4,149,272 A * 4/1979 Maeshima ..... A41D 3/00 2/102
4,181,993 A * 1/1980 McDaniel ..... B63C 9/125 441/108
4,320,538 A * 3/1982 Saft ..... A41D 15/007 2/102
4,354,281 A * 10/1982 Satoh ..... A47G 9/086 2/97
4,416,641 A * 11/1983 Spinosa ..... A41D 13/0125 441/107
4,420,521 A * 12/1983 Carr ..... A41D 31/02 428/74
4,471,759 A * 9/1984 Anderson ..... B29C 65/02 126/626
4,502,153 A * 3/1985 Lapedes ..... A41D 27/02 2/81
4,550,046 A * 10/1985 Miller ..... B29D 24/005 428/116
4,603,069 A * 7/1986 Haq ..... B32B 3/266 428/76
4,631,765 A * 12/1986 Casey ..... A47G 9/0207 428/33
4,656,065 A * 4/1987 Yacovella ..... A41D 13/00 2/1
4,665,851 A * 5/1987 Sweet ..... A41D 31/02 112/409
4,716,598 A * 1/1988 Bertram ..... A01K 13/008 2/108
4,748,703 A * 6/1988 Emi ..... A47G 9/0207 5/482
4,756,937 A * 7/1988 Mentzer ..... B32B 3/26 428/35.2
4,770,919 A * 9/1988 Tesch ..... A01G 13/0268 428/136
4,788,972 A * 12/1988 DeBusk ..... A61F 5/01 2/DIG. 1
4,833,731 A * 5/1989 Foxman ..... A41D 13/1254 2/47
4,839,934 A * 6/1989 Rojas ..... A47G 9/0207 5/485
4,864,656 A * 9/1989 Nesse ..... A41D 3/00 2/97
4,910,069 A * 3/1990 Isoe ..... A41D 27/20 428/173
4,962,554 A * 10/1990 Tesch ..... A47G 9/0207 5/502
4,971,041 A * 11/1990 Millikan ..... A61F 5/05833 128/878
5,001,783 A * 3/1991 Grilliot ..... A62B 17/003 2/81
5,044,013 A * 9/1991 Ackerman ..... A41D 25/16 139/426 R
5,072,455 A * 12/1991 St. Ours ..... A41D 13/0055 2/81
5,131,097 A * 7/1992 Grilliot ..... A62B 17/003 2/81
5,131,100 A * 7/1992 Atwater ..... A41B 9/02 2/400
5,150,476 A * 9/1992 Statham ..... A41D 31/085 2/93
5,199,121 A * 4/1993 Payne ..... A47G 9/0207 5/413 R
5,267,519 A * 12/1993 Uglene ..... B32B 7/08 112/440
5,299,333 A * 4/1994 Pedersen ..... A47G 9/10 5/486
5,343,578 A * 9/1994 Kettenhofen ..... A47G 9/086 2/69.5
5,408,700 A * 4/1995 Reuben ..... A41D 27/02 112/402
5,408,712 A * 4/1995 Brun ..... A47G 9/0207 5/486
5,445,863 A * 8/1995 Slagle ..... B32B 7/08 428/156
5,459,894 A * 10/1995 Buonocore ..... A47C 27/22 5/737
5,572,744 A * 11/1996 Reid, Jr. ..... A41D 19/01535 2/158
5,589,245 A * 12/1996 Roell ..... D03D 27/10 428/85
5,636,380 A * 6/1997 Schindler ..... A41D 13/005 2/69
5,657,497 A * 8/1997 Howe ..... A47G 9/086 2/243.1
5,708,995 A * 1/1998 Wu ..... A47G 9/0207 5/486
5,713,079 A * 2/1998 Simon ..... A41D 3/00 2/243.1
5,720,058 A * 2/1998 Hollander ..... A47G 9/0207 5/486
5,799,600 A * 9/1998 Reuben ..... A47G 9/0207 112/420
5,885,679 A * 3/1999 Yasue ..... A41D 27/24 428/57
5,896,583 A * 4/1999 Grilliot ..... A41D 13/00 2/81
5,901,373 A * 5/1999 Dicker ..... A41D 31/02 2/243.1
5,967,870 A * 10/1999 Bertoncelli ..... A41D 13/0125 441/107
5,987,669 A * 11/1999 Leggett ..... A47G 9/0207 5/502
6,009,560 A * 1/2000 McKenney ..... A41D 13/01 2/244
6,182,297 B1 * 2/2001 Duren ..... A41B 9/001 2/228
6,243,896 B1 * 6/2001 Osuna ..... A47G 9/0261 5/502
6,279,161 B1 * 8/2001 Johnston ..... A41D 13/0015 2/69
6,427,242 B1 * 8/2002 Bush ..... A41D 27/02 2/272

(56) References Cited

U.S. PATENT DOCUMENTS 6,449,787 B1 * 9/2002 Thorne ..... A47G 9/086 2/69.5
6,643,872 B1 * 11/2003 Buswell ..... A47G 9/0207 5/482
6,675,394 B2 * 1/2004 Egnew ..... A41D 13/00 2/227
6,808,791 B2 * 10/2004 Curro ..... A47L 1/15 239/53
6,961,970 B2 * 11/2005 Pedersen ..... A47G 9/0207 5/486
7,037,569 B2 * 5/2006 Curro ..... A47L 1/15 428/134
7,356,864 B1 * 4/2008 Delfs ..... A47G 9/0207 5/691
7,428,772 B2 * 9/2008 Rock ..... A41D 13/002 28/159
7,735,149 B2 * 6/2010 Jarvis ..... A41D 13/0025 2/69
7,827,624 B1 * 11/2010 Cole ..... A41D 13/0025 2/102
7,863,205 B2 * 1/2011 Stewart ..... B32B 5/12 442/135
7,870,623 B2 * 1/2011 Judd ..... A61H 7/001 5/502
7,977,261 B2 * 7/2011 Szczesuil ..... B32B 5/18 442/381
8,028,386 B2 * 10/2011 Rock ..... D04B 1/28 28/160
8,057,878 B2 * 11/2011 Lo ..... B32B 5/26 428/116
8,578,516 B2 * 11/2013 Li ..... A47G 9/02 2/97
8,647,168 B2 * 2/2014 Anvaripour ..... A41C 1/003 2/73
8,828,167 B2 * 9/2014 Hannon ..... B29C 66/723 156/73.4
8,978,179 B2 * 3/2015 De La Place ..... A47G 9/0207 5/502
9,186,002 B2 * 11/2015 Fan ..... A47G 9/0223
9,392,825 B2 * 7/2016 Pezzimenti ..... B29C 65/02
9,950,492 B2 * 4/2018 Banowit ..... B32B 3/20
10,111,480 B2 * 10/2018 Pezzimenti ..... A41B 11/00
10,245,454 B2 * 4/2019 Barbeau ..... A62B 17/003
10,251,436 B2 * 4/2019 Carter ..... A41D 31/00
10,362,820 B2 * 7/2019 Pezzimenti ..... B29C 65/62
10,413,099 B2 * 9/2019 Stewart ..... A47G 9/0223
10,492,550 B2 * 12/2019 Blakely ..... A41D 31/06
2002/0034913 A1 * 3/2002 Curro ..... A47L 1/15 442/381
2003/0182708 A1 * 10/2003 Gathings, Jr. ..... A41D 3/02 2/97
2004/0045143 A1 * 3/2004 Rock ..... A41D 3/005 28/159
2004/0175532 A1 * 9/2004 Rainbolt ..... B32B 5/26 428/74
2006/0046024 A1 * 3/2006 Huntley ..... A47G 9/0207 428/137
2006/0277950 A1 * 12/2006 Rock ..... A41D 13/002 66/169 R
2007/0084391 A1 * 4/2007 Stevens
2007/0245448 A1 * 10/2007 Bury ..... A41D 3/00 2/108
2007/0294800 A1 * 12/2007 Huang ..... A41D 3/00 2/97
2008/0005823 A1 * 1/2008 Hung ..... A41D 31/00 2/69
2008/0134441 A1 * 6/2008 Johnson ..... A47G 9/0207 5/690
2009/0100568 A1 * 4/2009 Judd ..... A61H 7/001 2/95
2009/0155543 A1 * 6/2009 Fowler ..... B29C 66/112 428/179
2009/0188017 A1 * 7/2009 Kruse ..... A41D 31/085 2/81
2010/0024701 A1 * 2/2010 Li ..... A47G 9/086 112/420
2010/0107333 A1 * 5/2010 Ortlieb ..... A47C 27/081 5/413 R
2010/0269242 A1 * 10/2010 Stubiger ..... A41D 13/01 2/81
2010/0272969 A1 * 10/2010 Taylor ..... B32B 37/14 428/196
2011/0119811 A1 * 5/2011 Rock ..... B32B 5/02 2/243.1
2012/0015155 A1 * 1/2012 Blackford ..... A43B 1/00 428/189
2012/0017346 A1 * 1/2012 Reimer ..... A41D 27/28 2/69
2012/0128995 A1 * 5/2012 Leto ..... C09D 175/04 428/473
2013/0177731 A1 * 7/2013 Moriarty ..... B32B 27/12 428/74
2013/0196109 A1 * 8/2013 Rock ..... A41D 31/0038 428/76
2013/0209735 A1 * 8/2013 Kim ..... B32B 3/14 428/141
2013/0276201 A1 * 10/2013 Pezzimenti ..... A41D 31/102 2/69
2014/0087104 A1 * 3/2014 Kierderle ..... A62B 17/003 428/35.2
2014/0250596 A1 * 9/2014 De La Place ..... A47G 9/0207 5/502
2014/0310848 A1 * 10/2014 Ulriksen ..... A41D 27/285 2/69
2014/0349057 A1 * 11/2014 Blackford ..... F16L 59/029 428/71
2014/0373277 A1 * 12/2014 Fan ..... A47G 9/0223 5/502
2015/0013068 A1 * 1/2015 Werthaiser ..... A47G 9/0207 5/502
2015/0290901 A1 * 10/2015 Banowit ..... B32B 3/20 428/188
2016/0039174 A1 * 2/2016 Wu ..... B32B 5/26 428/74
2016/0278459 A1 * 9/2016 Hilty ..... A41D 27/28
2016/0309790 A1 * 10/2016 Hicks ..... A41B 1/08
2016/0366963 A1 * 12/2016 Koshkaroff ..... A41D 27/28
2016/0374408 A1 * 12/2016 Seo ..... A41D 3/02 2/93
2017/0028669 A1 * 2/2017 Regester ..... B32B 3/266
2017/0065005 A1 * 3/2017 Nordstrom ..... A41D 13/002
2017/0120082 A1 * 5/2017 Barbeau ..... A62B 17/003
2017/0245560 A1 * 8/2017 Pezzimenti ..... A41D 31/125
2018/0098586 A1 * 4/2018 Pezzimenti ..... A41D 3/00
2018/0098588 A1 * 4/2018 Pezzimenti ..... A41D 27/24
2018/0125136 A1 * 5/2018 Giordani ..... A41D 31/0038
2018/0195216 A1 * 7/2018 Lin ..... D04B 1/12
2018/0271182 A1 * 9/2018 Shiraishi ..... A41D 31/00
2018/0289090 A1 * 10/2018 Turner ..... A41D 31/0038
2018/0317582 A1 * 11/2018 Lambertz ..... A41D 31/14
2018/0338563 A1 * 11/2018 Moretti Polegato ... A41D 31/02
2019/0069609 A1 * 3/2019 Blackburn ..... A41D 11/00
2019/0082751 A1 * 3/2019 Young ..... A41D 13/0015
2019/0183197 A1 * 6/2019 Schierenbeck ..... A41D 31/085
2019/0191788 A1 * 6/2019 Zorzin ..... A41D 3/02
2019/0328162 A1 * 10/2019 Rohweller ..... A41D 31/02
2020/0015530 A1 * 1/2020 Baker ..... A41D 27/28

* cited by examiner

JACKET WITH GRADUATED TEMPERATURE REGULATION

BACKGROUND OF THE INVENTION

The present invention relates to outerwear, and more specifically to insulated outerwear, such as jackets, coats and vests.

A wide variety of coats and jackets are available on the commercial market. Many coats and jackets are designed with insulation provided to contain body heat and maintain warmth. One common types of insulated coat or jacket is a puffer jacket (also known as a down jacket). A conventional puffer jacket includes an inner fabric layer and an outer fabric layer that are joined together in a way that creates a plurality of open, internal baffles between the layers. The baffles are filled with down insulation, synthetic insulation or a blend of down and synthetic insulation. These types of jackets are well known for providing warmth while still being light-weight and easily packable. Unfortunately, the highly insulative nature of these jackets can cause excessive build=up of heat and humidity in high-output activities, such as hiking, backpacking and other outdoor sports.

Outerwear manufacturers have developed a number of techniques for addressing the buildup of heat and humidity within coats and jackets. For example, some coats and jackets are provided with vents that allow heat and humidity escape. In some cases, the vents are fixed in the panels of the coat or jacket and remain open at all times. Although vents of this nature can be helpful, they provide for the free flow of air into and out of the jacket. To prevent the vents from allowing too much air exchange, vent are usually limited to relatively small regions of the coat or jacket. As a result, these types of conventional vents do not provide uniform temperature regulation throughout the jacket, but instead have a tendency to create excessively cool spots at each vent. These cool spots can be even more evident and potentially uncomfortable to the wearer during and after high-output activities. In some cases, the vents are configured to be opened by the wearer when it is desirable to allow venting. To illustrate, a number of commercially available coats and jackets include strategically located zippers that can be opened selectively (unzipped) to provide venting and closed (re-zipped) to preclude venting. With some products, a zipper is located in each armpit that can be unzipped to create a vent opening adjacent to the armpits to facilitate venting of heat and humidity from the armpit region. While this type of construction allows selective venting, the presence of a zipper in the armpit can cause discomfort, can create reliability issues and may affect the ability to provide a waterproof coat or jacket. Further, when the zippers are open, they may allow too much venting, thereby forcing the wearer to open and close the zippers repeatedly as the wearer becomes alternately too hot and then too cold.

As a result, there remains a long-felt and unmet need for outerwear capable of providing more balanced and controlled venting, and that results in improved temperature regulation and in more effective management of heat and humidity throughout.

SUMMARY OF THE INVENTION

The present invention provides a puffer jacket having a back panel with a baffle and insulation arrangement configured to provide improved temperature regulation through the use of graduated venting. The baffles are arranged to provide reduced insulation and increased venting of heat and humidity toward the center of the back. In one embodiment, the jacket includes a back panel including a plurality of laterally extending baffles in which the shape and/or amount of insulation varies from baffle to baffle to provide progressively less heat retention toward the center of the back. In one embodiment, alternating baffles have insulation or are free of insulation.

In one embodiment, the back panel has an inner layer, outer layer and insulation disposed between the inner and outer layers. The back panel is divided into a plurality of separate laterally extending baffles by joining the inner and outer layers together along laterally-extending lines. For example, the inner and outer layers may be joined by stitching, adhesive or bonding tape.

In one embodiment, the back panel includes insulation baffles and vent baffles. The insulation baffles include insulation and the vent baffles are free of insulation. In one embodiment, the back panel includes alternating insulation baffles and vent baffles.

In one embodiment, the insulation baffles and vent baffles are defined by laterally extending lines of stitching. The lines of stitching may follow a profile configured to provide the vent baffles with greater height and the insulation baffles with lesser height toward the center of the back panel. The lines of stitching may be configured to provide the insulation baffles with an hourglass shape resulting in a narrowing of the insulation baffles toward the center of the back a widening of the vent baffles toward the center of the back.

In one embodiment, the jacket includes gender-specific back panel baffle configurations. The men's jacket includes a higher level of venting than the women's jacket.

The present invention provides a simple and effective jacket construction with graduate venting properties that provide increased venting toward the center of the back panel. In those applications that include stitched baffles, the graduated baffles can be easily manufactured by changing the path along which the stitching crosses the back panel. The present invention is particularly well-suited for use in hiking and other high-output outdoor activities. Graduated venting of the back panel can provide enhanced benefits when hiking with a back pack because it facilitates venting of heat and humidity that might build up beneath the backpack.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Overview

Figure 2:
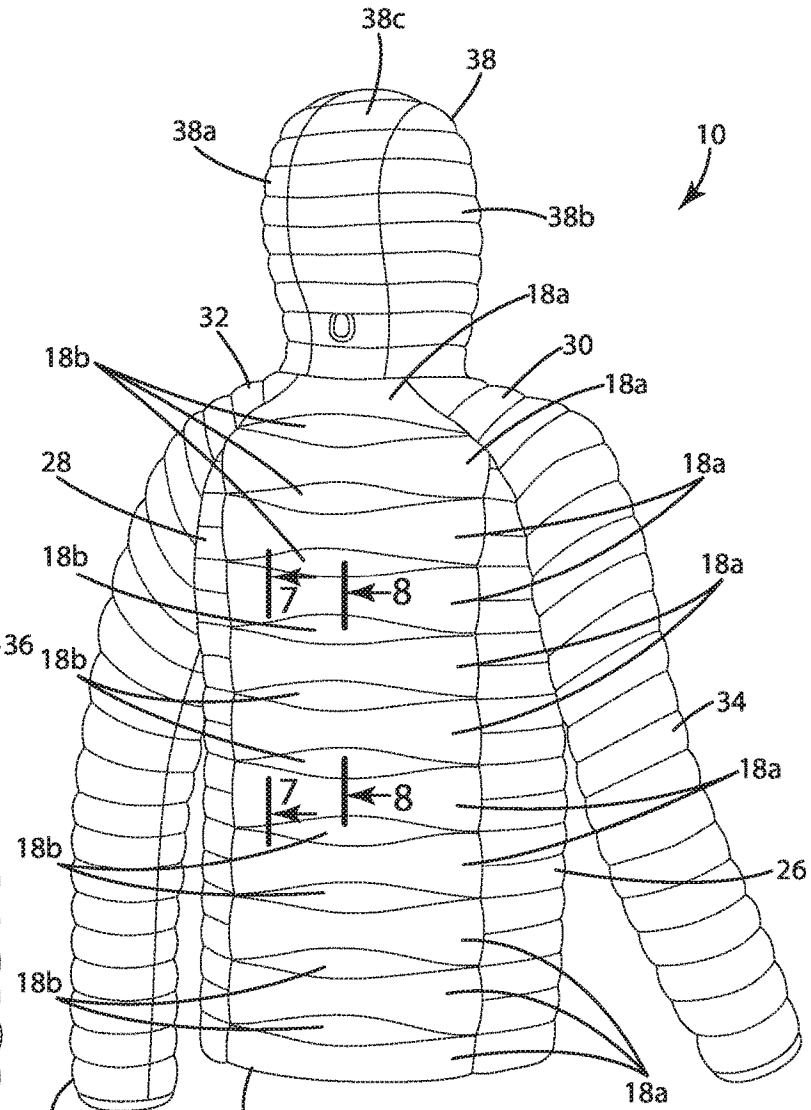
FIG. 2 is a rear perspective view of a jacket in accordance with an embodiment of the present invention.
Figure 1:
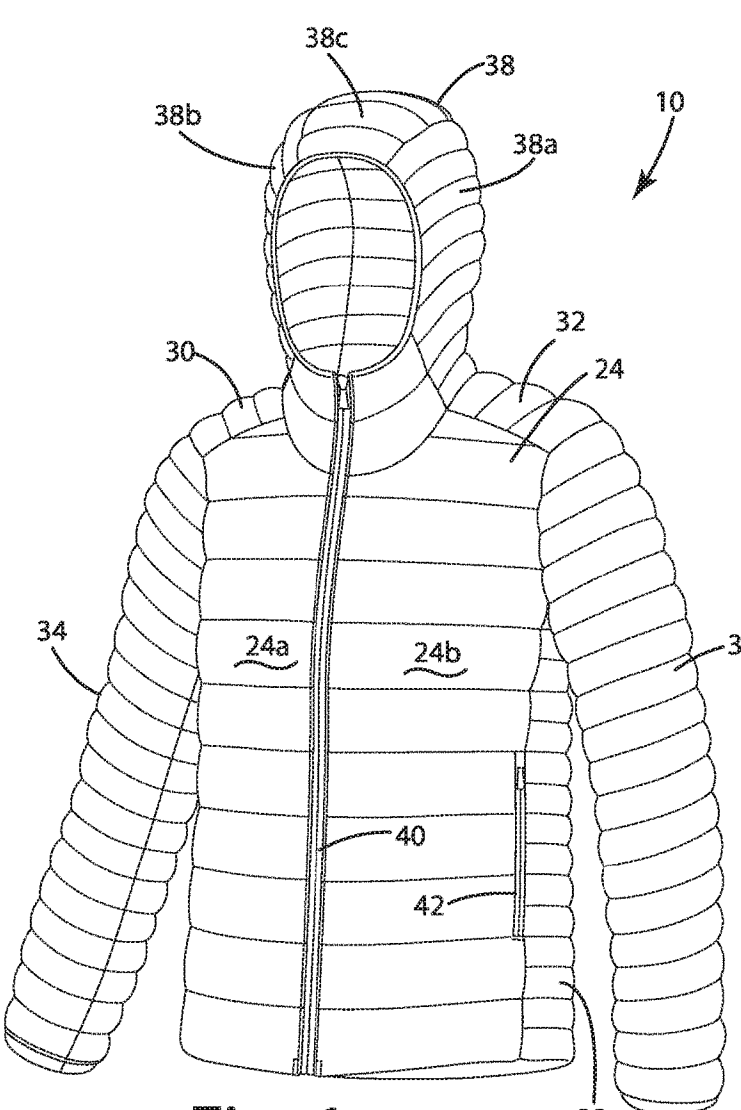
FIG. 1 is a rear perspective view of a jacket in accordance with an embodiment of the present invention.
Figure 3:
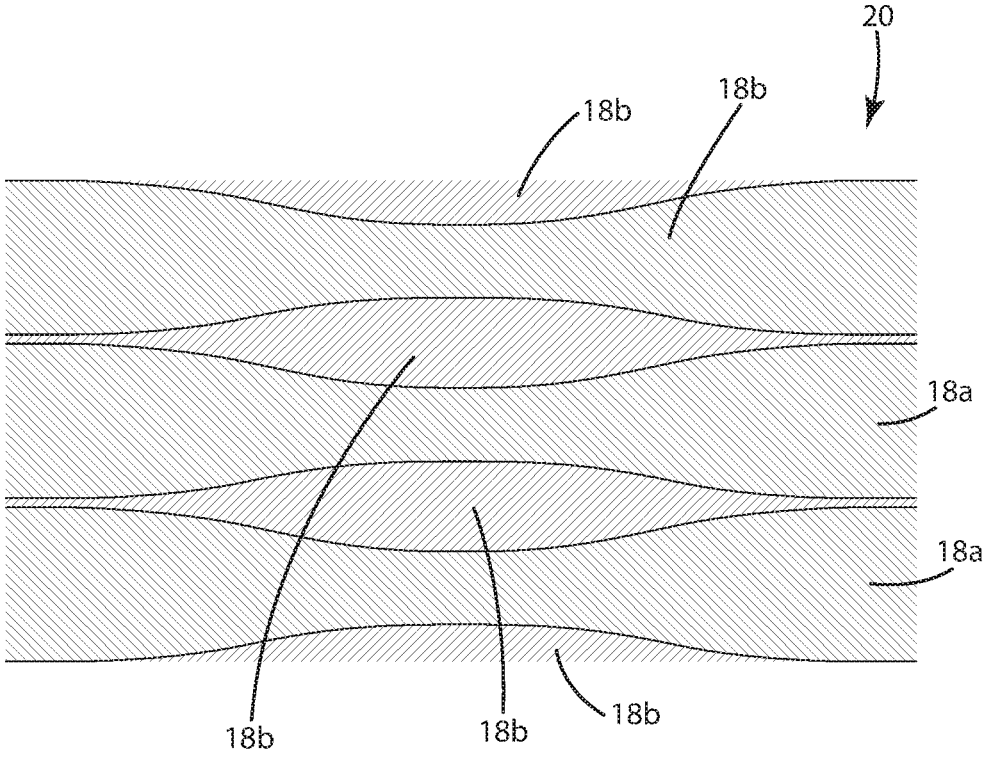
FIG. 3 is an enlarged representational view of a portion of the back panel.
Figure 10:
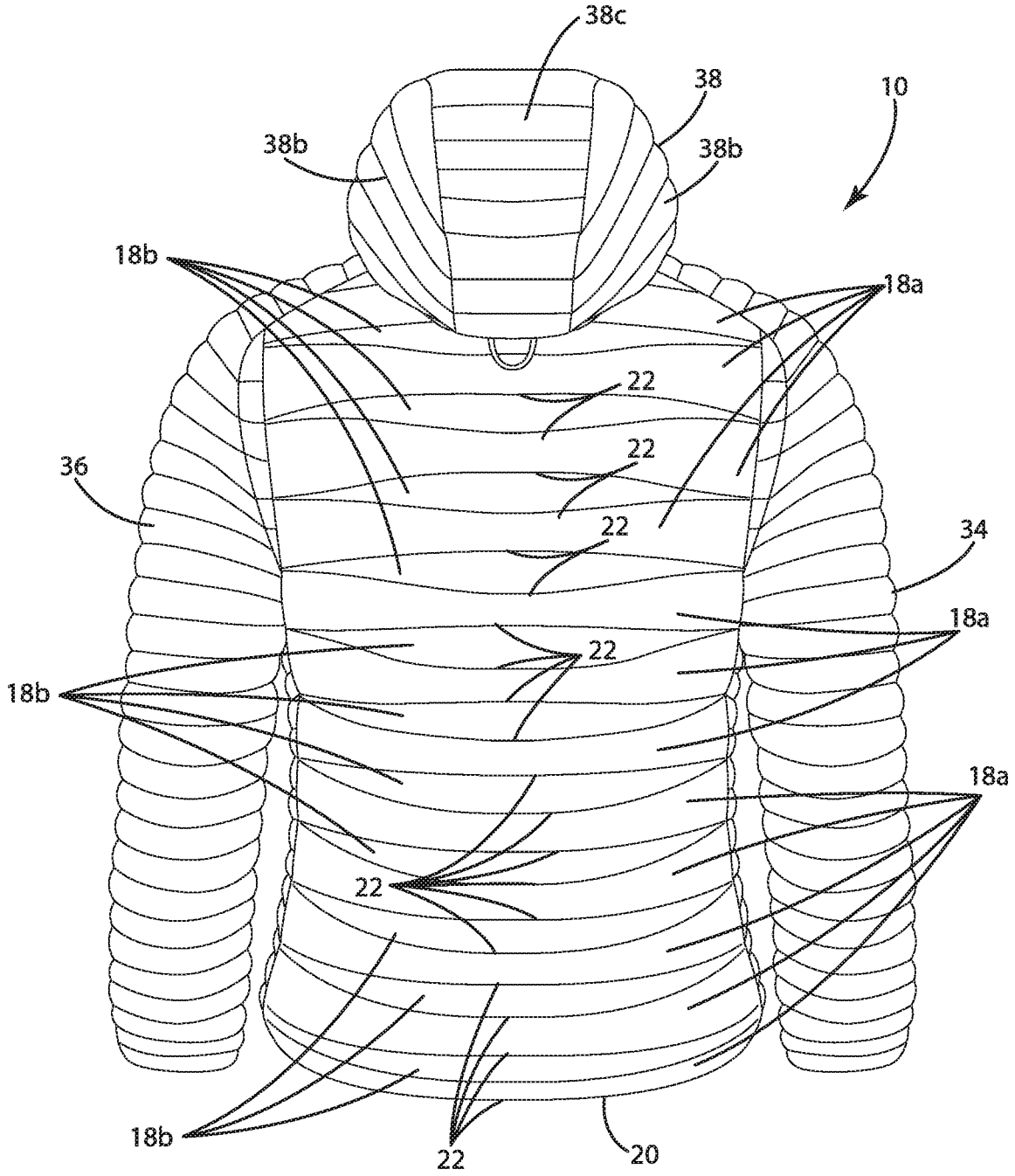
FIG. 10 is a perspective view of the jacket of FIG. 1.

A jacket in accordance with an embodiment of the present invention is shown in FIGS. 1, 2 and 10 and generally designated 10. The jacket 10 is a puffer jacket with an inner layer 12, an outer layer 14 and an insulation material 16 filling baffles 18*a-b* formed by selectively joining the inner layer 12 and the outer layer 14. In the illustrated embodiment, the baffles 18*a-b* are configured to provide controlled venting in select portions of the jacket 10. As shown in FIG. 1, the jacket 10 includes a back panel 20 in which the baffles 18*a-b* are configured to provide graduated venting to the back of the jacket 10. In this embodiment, the shape of the baffles 18*a-b* and the amount of insulation 16 contained in each baffle 18*a-b* are varied to control the bending characteristics of the jacket 10. With jacket 10, the baffles 18*a-b* are defined by a plurality of lines of stitching 22 that extend transversely across the back from left to right. The lines of stitching 22 follow paths configured to vary the shape of adjacent baffles 18*a-b*. Further, in this embodiment, the back panel 20 includes alternating insulation baffles 18*a* and vent baffles 18*b*. The vent baffles 18*b* are empty of insulation 16 so that every other baffle 18*a-b* in the back panel 20 provides enhanced venting. As shown in FIG. 3, the lines of stitching 22 in jacket 10 follow a profile configured to provide the vent baffles 18*b* with greater height and the insulation baffles 18*a* with lesser height toward the center of the back panel 20. While the precise shape of the lines of stitching 22 may vary, the lines of stitching 22 in jacket 10 provide the insulation baffles 18*a* with an hourglass shape that results in a narrowing of the insulation baffles 18*a* toward the center of the back a widening of the vent baffles 18*b* toward the center of the back. This configuration provides the back panel 20 with graduated venting that allows progressively greater venting of heat and humidity toward the center along the full height of the back. This arrangement not only improves the positioning of venting, but also spreads venting over a much greater area than conventional venting arrangements, thereby providing improved temperature regulation.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Figure 5:
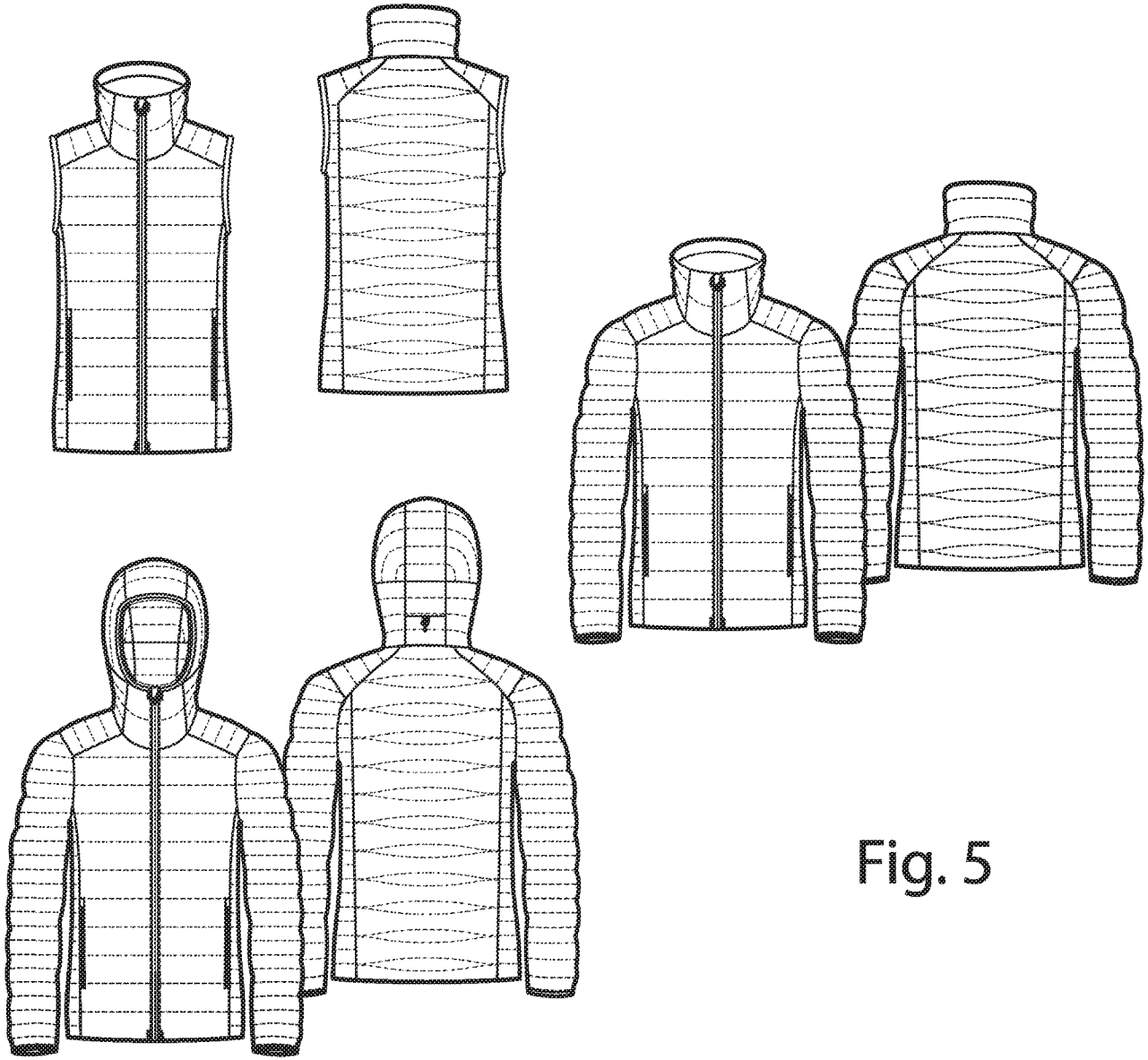
FIG. 5 shows various implementations of the present invention in men's outerwear.
Figure 6:
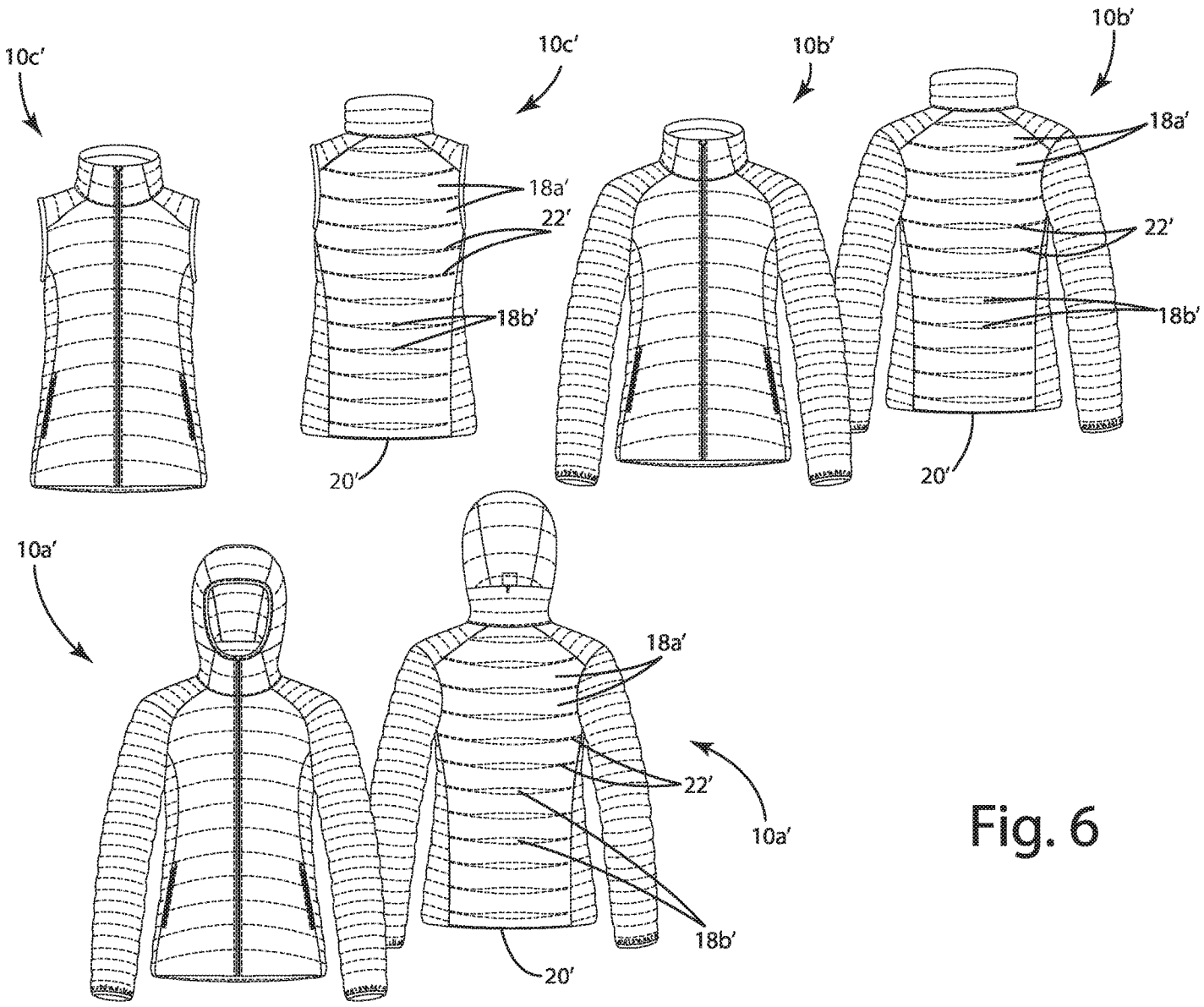
FIG. 6 shows various implementations of the present invention in women's outerwear.

Although described in the context of a specific hooded jacket 10, the present invention may be incorporated into a wide range of outerwear product, including a wide range of coats, jackets and other apparel items that might include insulation contained in baffles. For example, FIG. 5 shows men's vest, men's jacket and men's hooded jacket embodiments of the present invention and FIG. 6 shows women's vest, women's jacket and women's hooded jacket embodiments of the present invention. Further, the present invention may be incorporated into outerwear designed for use in essentially any temperature range. For example, the size and shape of the baffles, as well as the volume and insulative characteristics of the insulation material may be selected to provide a range of outerwear products tuned for use in temperature ranges from mild to extreme cold.

Hooded Jacket.

As noted above, the present invention is described in connection with a puffer jacket 10 having a back panel 20 with baffles 18*a-b* configured to provide the back with graduated insulation and venting properties that result in improved temperature regulation. In the illustrated embodiment, jacket 10 is formed by joining together a plurality of panels that cooperatively form the desired shape. The jacket 10 of FIG. 1 generally includes a front panel 24, a right side panel 26, a left side panel 28, a back panel 20, a right shoulder panel 30, a left shoulder panel 32, a right sleeve 34, a left sleeve 36 and a hood 38. Each of these panels may be formed by an arrangement of subpanels. For example, the hood 38 may be formed by joining left, right and center subpanels 38*a*, 38*b* and 38*c*, respectively, and the front panel 24 may be formed from left and right subpanels 24*a* and 24*b* that can be joined to close the jacket 10. In the illustrated embodiment, graduating venting is incorporated only into the back panel 20. As a result, the remaining panels are designed and manufactured in a generally conventional manner, and will not be described in detail. Suffice it to say that each of these panels may include inner and outer layers that are joined together, for example, by lines of stitching, to form baffles that are filled with the desired type and volume of insulation. Each of the inner and outer layers may include one or more layers of fabric, textile or other materials. If applications where either inner or outer layer includes more than one layer, the separate layers may be laminated or otherwise joined. For example, two layers may be joined by cement or other adhesive, or may be fused together if they include fusible components. The various panels of the jacket 10 are joined together by stitching, adhesive and/or other suitable technique. The front panel 24 of this embodiment is separated into right and left subpanels 24*a* and 24*b* that are capable of being selectively joined by a zipper 40. The zipper 40 may be replaced or supplemented by other closures. Further, trim, pockets and other openings and accessories may be incorporated into any one or more of the panels. For example, trim may be added around the hood opening and/or the cuffs of the sleeves. As another example, zippered pockets 42 may be added to the front panel 24 using generally conventional techniques. In the illustrated embodiment, the front panel 24 includes hand pockets 42, but could include alternative or additional pockets, such as a breast pocket or an interior pocket. Additionally, the hood 38 may be provided with a drawstring or other closure.

It should be noted that while the present invention includes graduated venting only in the back panel 20, graduated venting may, however, be incorporated into other panels. For example, graduated venting may be incorporated into the side panels 26 and 28 to provide enhanced venting toward the center of the side panels, and/or graduated venting may be incorporated into the sleeves 34 and 36 to provide enhanced venting along the center, inside of the sleeves 34 and 36 (i.e. facing the side panels 26 and 28, respectively).

Figure 7:
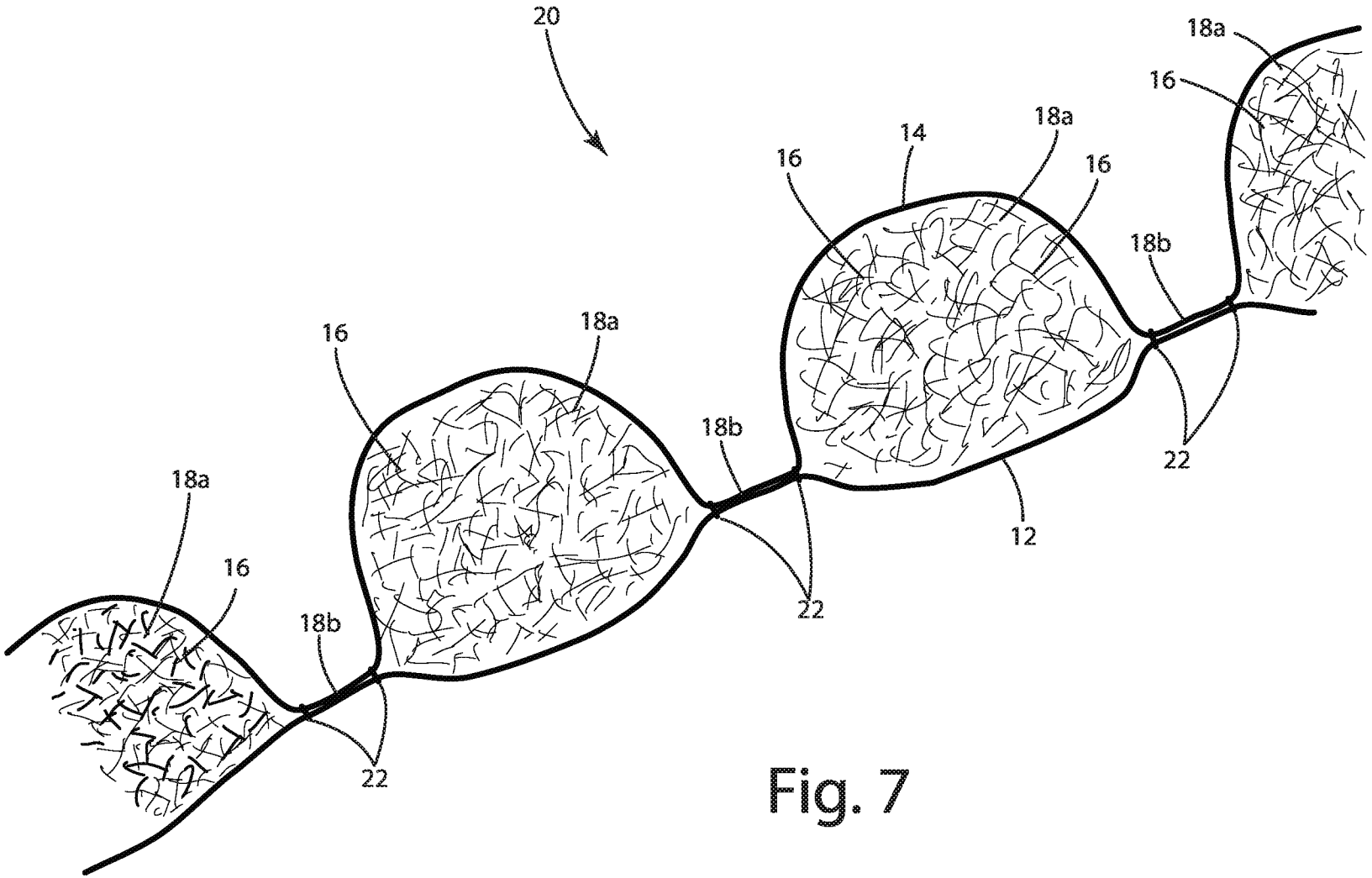
FIG. 7 is an enlarged cross-sectional view of a portion of the back panel taken along line 7-7 of FIG. 2.
Figure 8:
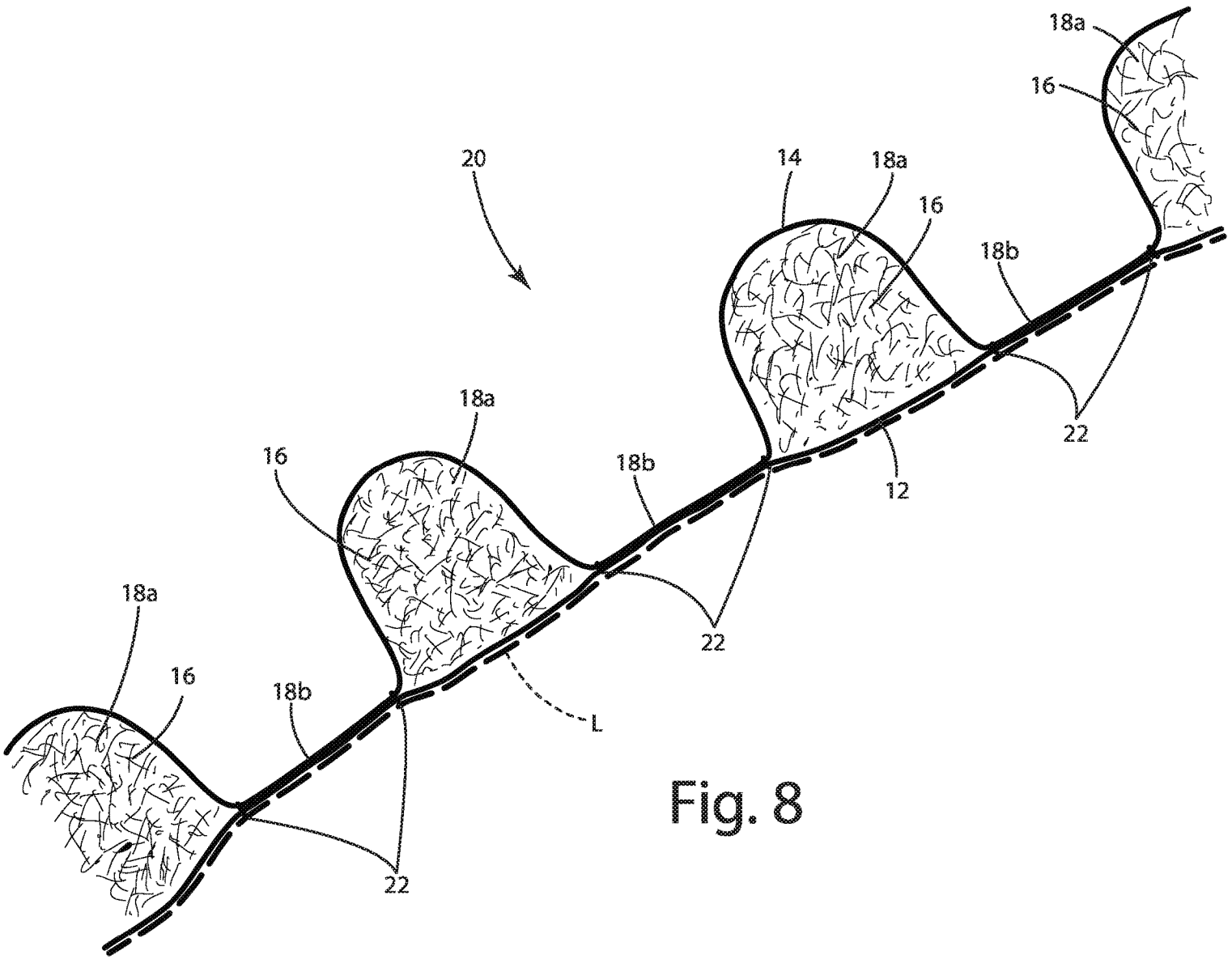
FIG. 8 is an enlarged cross-sectional view of a portion of the back panel taken along line 8-8 of FIG. 2.

As noted above, the jacket 10 includes a back panel 20 that includes graduating venting in accordance with the present invention. Referring now to FIGS. 7 and 8, the back panel 20 has an inner layer 12, an outer layer 14 and insulation 16 disposed between the inner and outer layers. In this embodiment, the inner layer 12 and the outer layer 14 are manufactured from a polyester fabric or a polyester blend fabric. For example, the outer layer 14 may be manufactured from a 65/35 polyester/cotton micro rip-stop fabric, available from Toray Industries. The inner layer 12 and outer layer 14 may, however, be manufactured from essentially any suitable fabric. The outer layer 14 may have a durable water repellant coating when it is desirable to provide a water resistant or waterproof jacket. The inner and outer layers 12 and 14 may, however, be manufactured from any individual layer or combination of layers of essentially any fabric, textile or other material suitable for forming the jacket shell. In some applications, the interior of the back panel 20 and/or other panels may be lined with a liner (represented by broken line L in FIG. 8). For example, the liner may be selected to provide a soft and comfortable interface with the wearer's skin. In typical applications, the materials used to form the inner and outer layers 12 and 14 of the back panel 20 will be used to form the other panels of the jacket 10.

The back panel 20 is divided into a plurality of separate laterally extending baffles by joining the inner layer 12 and the outer layer 14 together along laterally extending lines. For example, in the illustrated embodiment, a plurality of lines of stitching 22 extend laterally across the back panel 20 to join the inner and outer layers 12 and 14. The lines of stitching 22 are spaced apart from one another to form baffles 18*a-b* between the lines of stitching 22. Although the baffles 18*a-b* are defined by stitching 22 in the illustrated embodiment, the inner and outer layers may be joined in other ways to create an interior space capable of containing insulation. For example, the inner and outer layers 12 and 16 may be joined by adhesive or strips of bonding tape that extend laterally across the back panel 20. The size, shape and configuration of the baffles 18*a-b* may vary from application to application. For example, the distance between adjacent lines of stitching 22 and the amount of insulation 16 filling each baffle 18*a-b* may be varied. In some applications, the amount of material forming the inner layer 12 and the outer layer 14 between adjacent lines of stitching 22 may be varied to control the shape of the insulation-filled baffles. For example, more material may be used in forming the outer layer 14 between lines of stitching 22 to cause the baffles 18*a-b* to bulge more in an outwardly direction and less in an inwardly direction.

Figure 4:
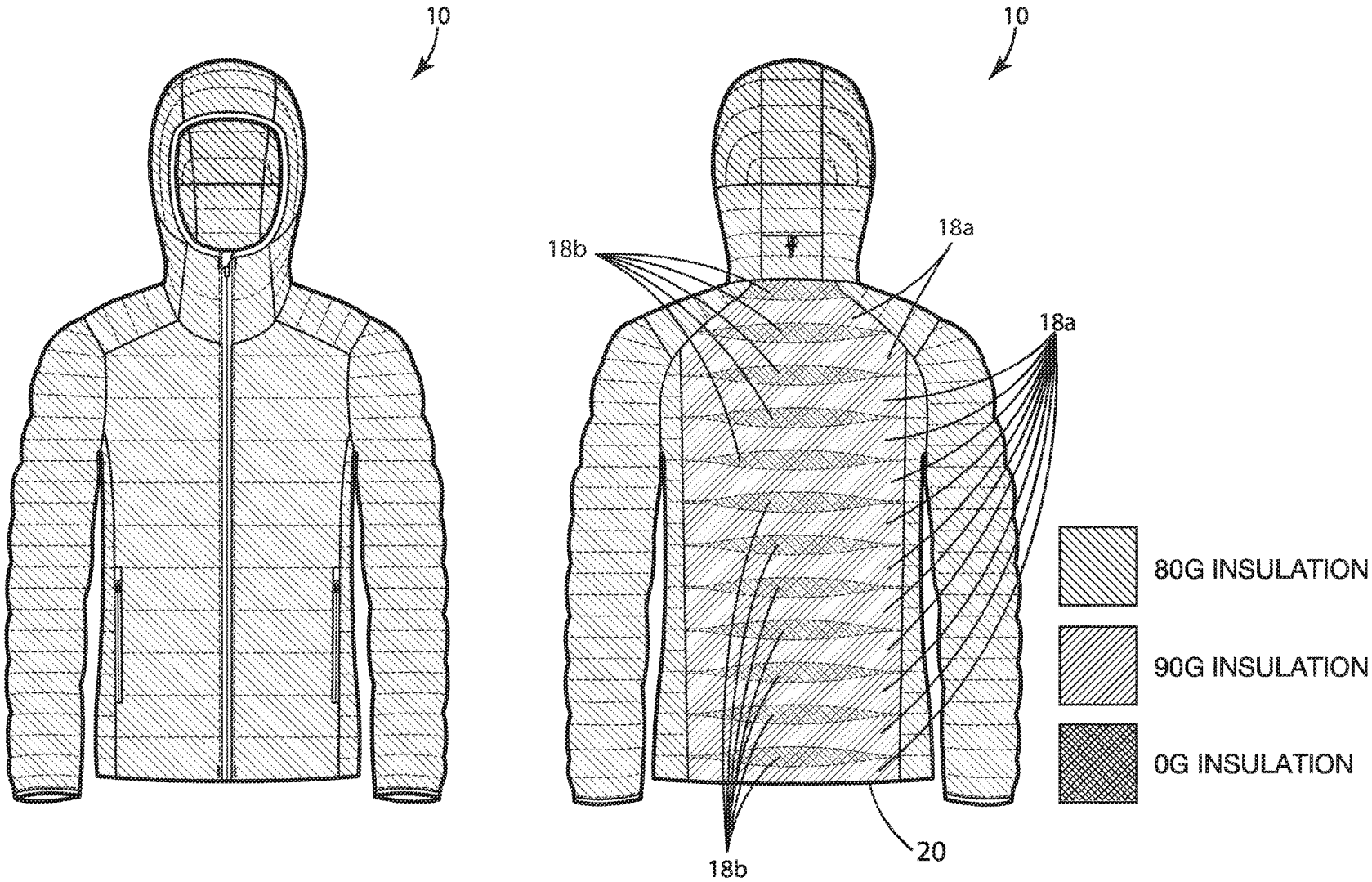
FIG. 4 is an illustration showing the insulation weight of the jacket throughout various regions.

The jacket 10 may include essentially any type of insulation. For example, the insulation may be natural down (e.g. goose down), synthetic insulation (e.g. synthetic down) or a blend of natural and synthetic insulations. In the illustrated embodiment, the insulation material is a blend containing 65% natural down and 35% synthetic insulation. The natural down may be water-resistant and RDS certified goose down. The synthetic insulation may be waterproof, Primaloft™ Gold Eco Synthetic Down. In the illustrated embodiment, the same type of insulation is used throughout the jacket 10, but the amount of insulation may vary from region to region. For example, as shown in FIG. 4, the insulation baffles 18*a* in the back panel 20 include 90G of insulation, the vent baffles 18*b* in the back panel 20 include no insulation and the baffles throughout the remainder of the jacket 10 include 80G of insulation. The insulation arrangement of the illustrated embodiment is merely exemplary, and the types and amounts of insulation may vary from product to product and from region to region within each product.

In the illustrated embodiment, the baffles 18*a-b* and insulation 16 are arranged in the back panel 20 to provide reduced insulation and increased venting of heat and humidity toward the center of the back panel 20. The back panel 20 of the illustrated embodiment includes a plurality of laterally extending baffles 18*a-b* in which the shape of the baffles and/or amount of insulation varies from baffle to baffle to provide progressively less heat retention toward the center of the back. In this embodiment, the back panel 20 has alternating baffles 18*a-b* that vary in shape and in amount of insulation. Referring now to FIGS. 2-4, the back panel 20 includes an arrangement of insulation baffles 18*a* that include insulation and vent baffles 18*b* that are free of insulation. In the back panel 20 of the illustrated embodiment, the baffles 18*a-b* repeatedly alternate between insulation baffles 18*a* and vent baffles 18*b*. Although the insulation baffles 18*a* and vent baffles 18*b* alternate in a regular repeating pattern, that is not strictly necessary and the arrangement may vary in alternative embodiments. The baffles 18*a-b* may be arranged with essentially any arrangement and/or combination of insulation baffles 18*a* and vent baffles 18*b*.

Figures 11, 12:
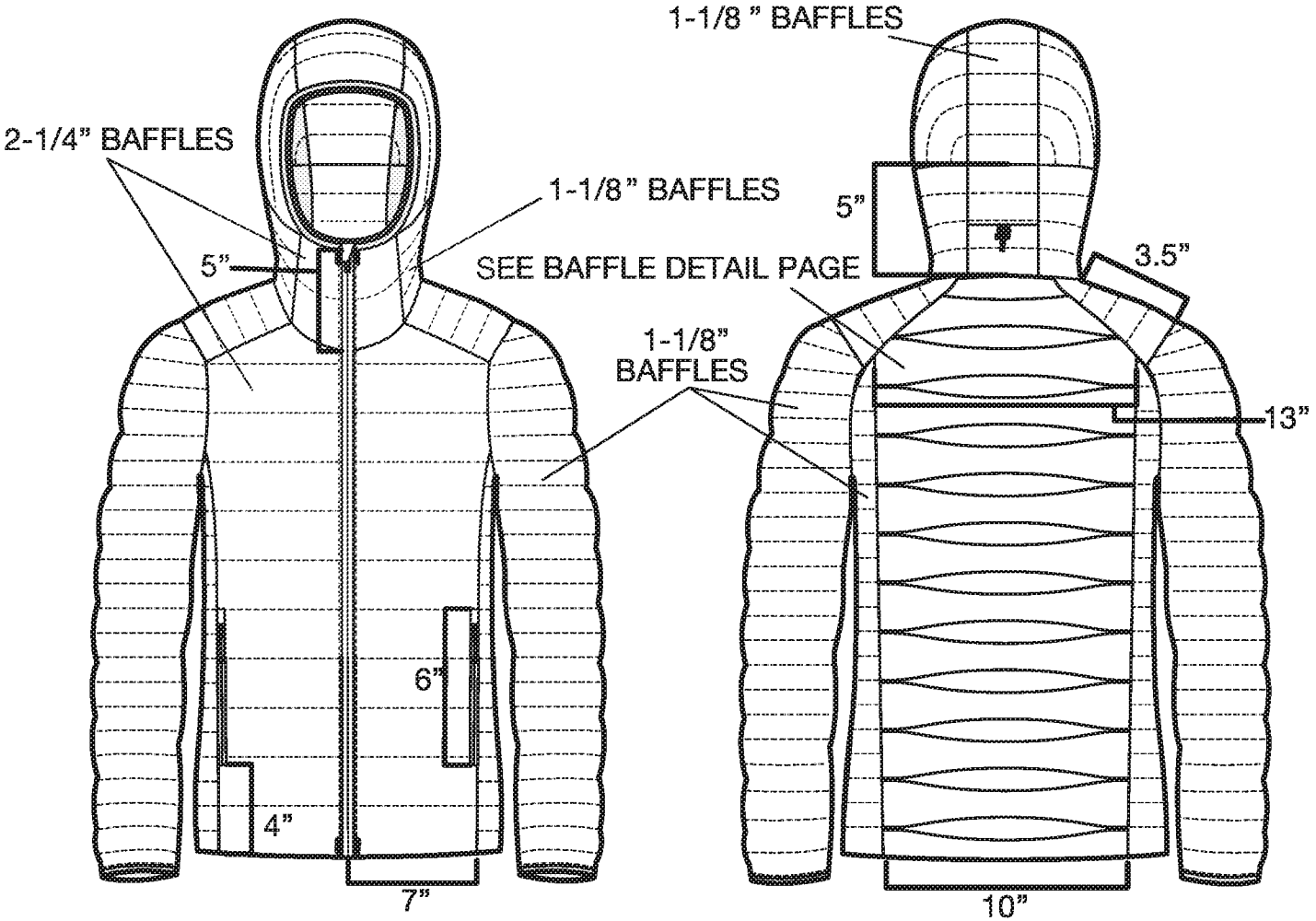
FIG. 11 is a front view of the jacket showing dimensions.
FIG. 12 is a rear view of the jacket showing dimensions.
Figure 13:
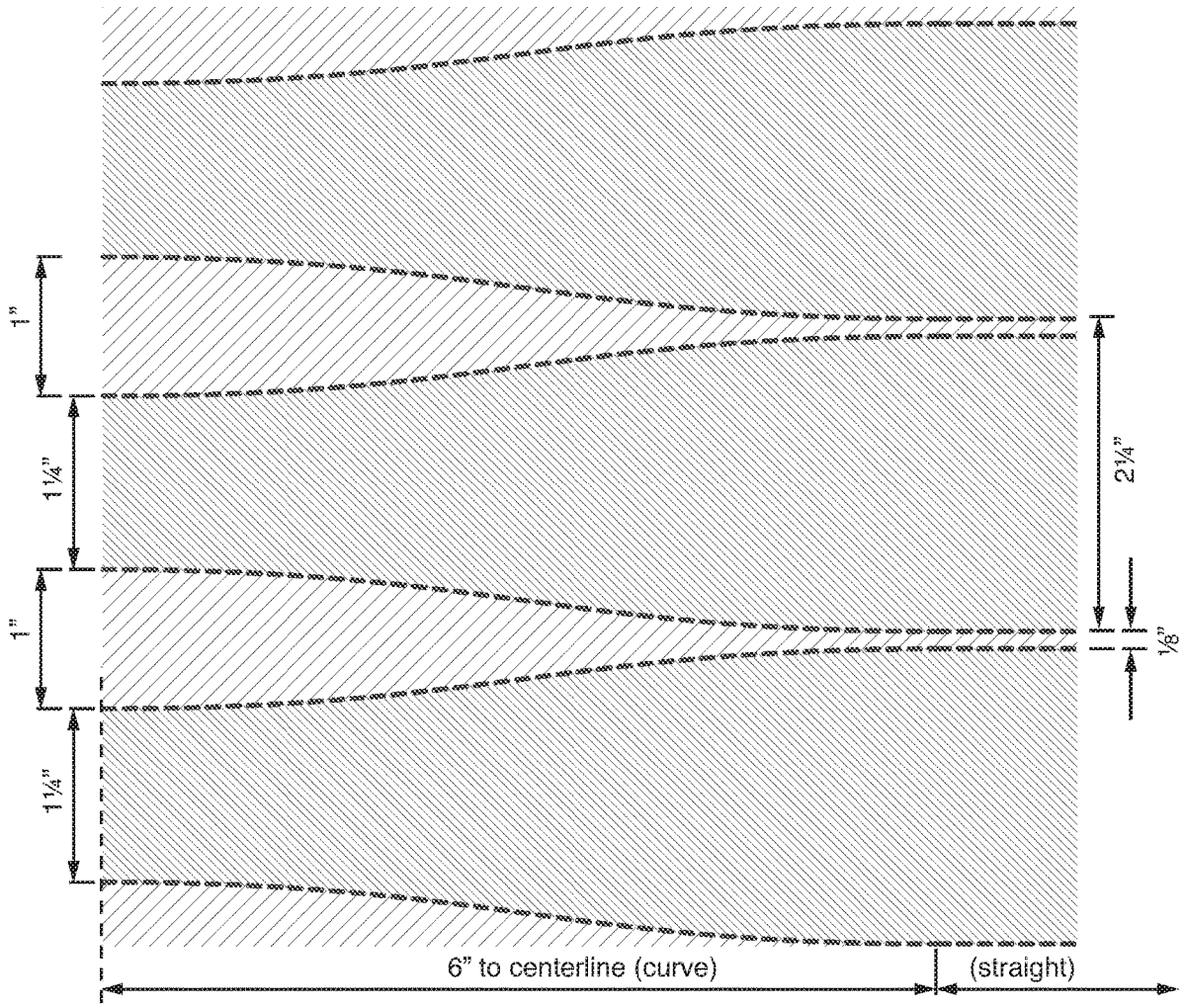
FIG. 13 is an enlarged representational view of a portion of Area S of FIG. 3.

In the illustrated embodiment, the shape of the baffles 18*a-b* varies across the back panel 20. More specifically, the relative height of the insulation baffles 18*a* and the vent baffles 18*b* varies with the vent baffles 18*b* having greater height toward the center of the back panel 20. In this embodiment, the insulation baffles 18*a* and vent baffles 18*b* are defined by laterally extending lines of stitching 22. Each line of stitching 22 defines the top of the immediately below baffle 18*a-b* and the bottom of the immediately above baffle 18*a-b*. As a result, variations in the line of stitching simultaneously affect the shape of the above and below baffles 18*a-b*. In the illustrate embodiment, the lines of stitching 22 follow paths across the width of the back that are selected to provide the vent baffles 18*b* with greater height and the insulation baffles 18*b* with lesser height toward the center of the back panel. The lines of stitching 22 of this embodiment provide the insulation baffles 18*a* with an hourglass shape resulting in a reduction in the height of the insulation baffles 18*a* toward the center of the back and an increase in the height of the vent baffles 18*b* toward the center of the back. For example, FIG. 7 is a cross-sectional illustration of a portion of the back panel 20 taken along line 7-7 of FIG. 2 at a location toward the side of the back panel 20 where the insulation baffles 18*a* have significantly great height than the vent baffles 18*b*. FIG. 8 is a similar cross-sectional illustration, except take along line 8-8 of FIG. 2 at a location that is approximate at the center of the back panel 20. As can be seen, the insulation baffles 18*a* and the vent baffles 18*b* have roughly the same height in FIG. 8. FIGS. 11-13 are marked with dimensions for the illustrated embodiment. These dimensions are exemplary and the size, shape and configuration of the insulation baffles and vent baffles may vary from application to application. As the vent baffles 18*b* occupy a greater and greater percentage of the back panel 20 toward the center of the back panel 20, the back panel 20 provides greater and greater venting for heat and humidity. Although the lines of stitching 22 may follow a gradual undulating curve (as perhaps best shown in FIG. 3), the lines of stitching 22 may follow essentially any other paths that provides the desired graduated venting profile. For example, the lines of stitching may alternative have linear rather than curved segments or may have a combination of linear and curved segments.

In the illustrated embodiment, the jacket 10 includes a gender-specific baffle configuration. When implementing gender-specific configurations in the back panel, the men's jacket will generally include a higher level of venting than the women's jacket. For example, the relative height of the insulation baffles and vent baffles may differ between the men's jacket and the women's jacket. FIG. 6 shows various women's outerwear products 10*a-c*' that include graduated venting in the back panel 20'. As shown, the configuration of the lines of stitching 22' in the women's jackets 10*a-c*' varies from the configurations in the men's jacket 10 (compare the men's products of FIG. 5 with the women's products of FIG. 6). In the illustrated embodiment, the lines of stitching 22 in the men's jacket 10 are configured to provide the insulation baffles 18*a* with a generally hourglass shape. However, in the women's jacket 10*a-c*' the lines of stitching 22' that form the bottom of each vent baffle 18*b*' are generally straight, thereby reducing the amount of variation in relative height between the insulation baffles 18*a*' and the vent baffles 18*b*' toward to the center of the back. As shown in FIG. 6, every other line of stitching 22' is essentially straight. In alternative embodiments, the lines of stitching 22' may be configured differently to achieve the desired level of graduated venting. For example, instead of making every other line of stitching straight, the degree of deviation in the top and bottom stitching lines 22' for each vent baffle 18*b*' may be reduced.

Figure 9:
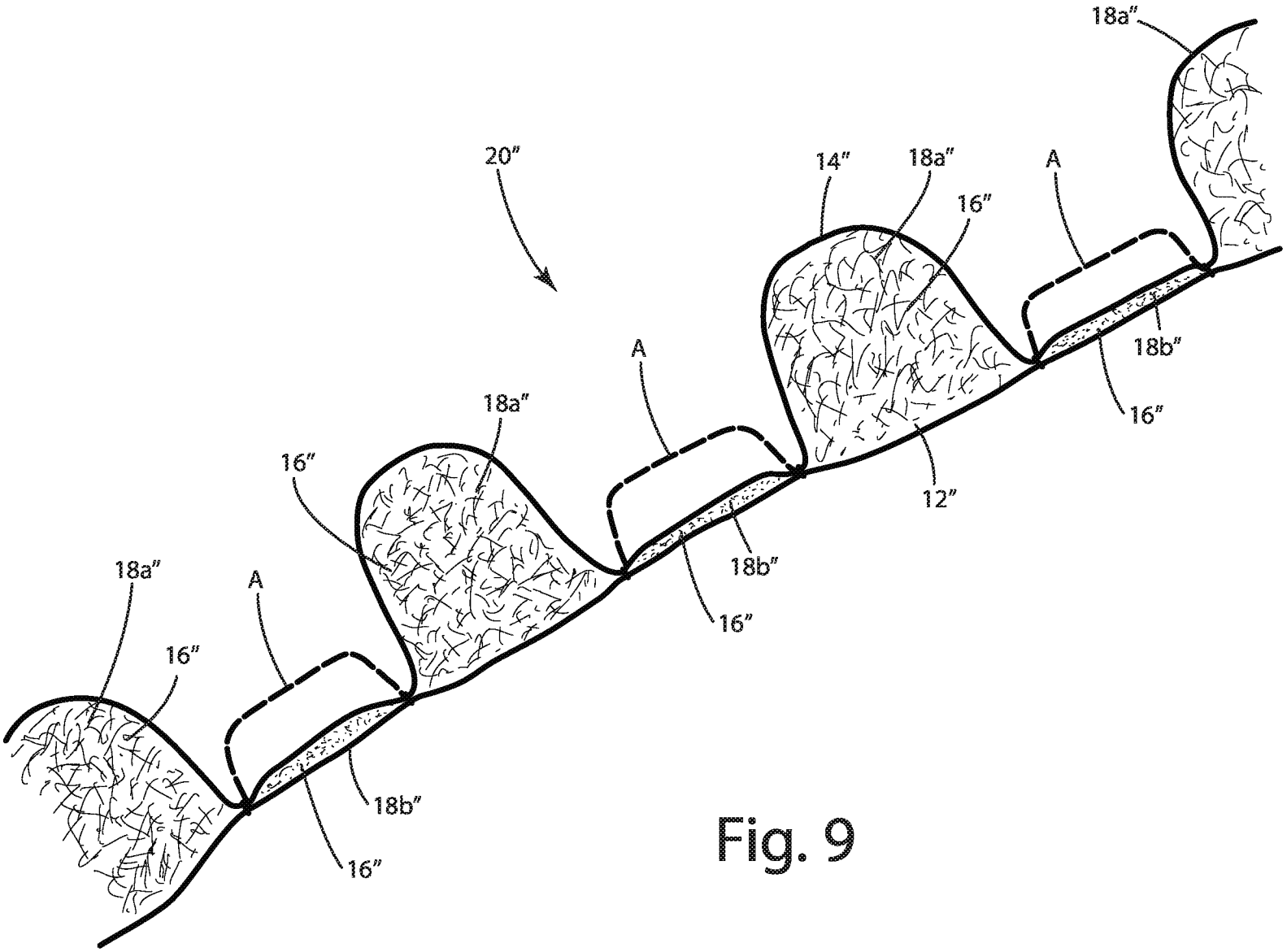
FIG. 9 is an enlarged cross-sectional view of a portion of the back panel illustrating various alternative embodiments.

In the illustrated embodiment, the vent baffles 18*b* are entirely free of insulation. However, the vent baffles 18*b* do not necessarily need to be entirely void of insulation. In alternative applications, the desired level of temperature regulation may be achieved by providing vent baffles 18*b* that are not empty, but have materially less insulation than the insulation baffles 18*a*. Additionally or alternatively, the insulation baffles 18*a* and vent baffles 18*b* may include different types of insulation that creates a material difference in the insulative properties of the different types of baffles 18*a-b*. To illustrate, FIG. 9 shows an alternative embodiment in which the back panel 20" includes vent baffles 18*b*" that contain a relatively small amount of insulation. The amount of insulation in the baffles 18*a-b*" is selected to control the temperature profile of the back panel 20". For example, in cold-weather applications, the vent baffles 18*b*" may include insulation 16" in a volume of approximately 10% of the volume of the insulation baffles 18*a*". As another example, the amount of insulation 16" in the vent baffles 18*b*" may be increased to approximately 35% of the volume of insulation of the insulation baffles 18*a*" (as shown by broken line A). Additionally or alternatively, the vent baffles 18*b*" may include an insulation material 16" with an insulation-factor that is no more than approximately 10% of the insulation-factor of the insulation baffles 18*a*", or no more than approximately 35% of the insulation-factor of the insulation baffles 18*a*".

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. An item of outerwear comprising:

a front panel and a back panel, the back panel having:

an outer layer of fabric;

an inner layer of fabric; and a plurality of lines of stitching extending across the outer layer of fabric and the inner layer of fabric, the plurality of lines of stitching joining the outer layer of fabric and the inner layer of fabric to define a plurality of baffles, a first plurality of the baffles including insulation to form a plurality of insulation baffles, a second plurality of the baffles being free of insulation to form a plurality of vent baffles;

wherein the plurality of insulation baffles and the plurality of vent baffles are arranged side-by-side in a single layer of baffles;

wherein the back panel has a central portion extending vertically along a midline of the back panel; and wherein the plurality of lines of stitching defining the plurality of baffles each follow a graduated lateral profile such that the plurality of insulation baffles each decrease in height toward the central portion, and the plurality of vent baffles each increase in height toward the central portion, such that the back panel has a graduated venting profile corresponding to the graduated lateral profile of the plurality of lines of stitching, the graduated venting profile including increased venting at the central portion and decreased venting away from the central portion.

2. The item of outerwear of claim 1 wherein the plurality of lines of stitching define alternating insulation baffles and vent baffles.

3. The item of outerwear of claim 2 wherein each insulation baffle is defined by an adjacent pair of the lines of stitching, the adjacent pair of the lines of stitching undulating toward one another toward the central portion of the back panel.

4. The item of outerwear of claim 3 wherein each vent baffle is defined by the lines of stitching of adjacent insulation baffles.

5. The item of outerwear of claim 4 wherein each insulation baffle has a generally hourglass shape with a narrow region toward the central portion of the back panel.

6. The item of outerwear of claim 1 wherein the plurality of vent baffles each increase in height along two opposing directions extending laterally inwardly toward the central portion of the back panel.

7. The item of outerwear of claim 6 wherein the plurality of insulation baffles each decrease in height along the two opposing directions extending laterally inwardly toward the central portion of the back panel.

8. The item of outerwear of claim 6 wherein the plurality of vent baffles each have a maximum height at the central portion of the back panel and a decreasing height in two opposing lateral directions extending away from the central portion of the back panel.

9. The item of outerwear of claim 6 wherein:

the back panel has a width, the plurality of baffles extending laterally across the width of the back panel.

10. The item of outerwear of claim 1 wherein:

the plurality of lines of stitching define alternating insulation baffles and vent baffles; and each insulation baffle is defined by an adjacent pair of the lines of stitching, the adjacent pair of the lines of stitching undulating toward one another toward the lateral center of the back panel to concurrently decrease the height of the insulation baffles and increase the height of the vent baffles.

11. An item of outerwear comprising:

a plurality of panels joined in a shape configured to clothe at least a portion of a wearer's upper body, the plurality of panels including a back panel positioned to cover at least a portion of a back of the wearer; the back panel including a central portion extending vertically along a midline of the back panel; and wherein the back panel includes an inner layer, an outer layer, and a plurality of laterally extending lines of stitching, the lines of stitching joining the inner layer and the outer layer to define a plurality of laterally extending baffles, the plurality of laterally extending baffles including:

a plurality of insulation baffles, each of the plurality of insulation baffles defining an internal void with insulation disposed in each respective internal void; and a plurality of vent baffles, each of the plurality of vent baffles defining an internal void, each internal void of the plurality of vent baffles being free of insulation;

wherein the plurality of insulation baffles and the plurality of vent baffles are arranged side-by-side in a single layer of baffles; and wherein the plurality of lines of stitching defining the plurality of baffles each follow a graduated lateral profile, such that the plurality of vent baffles increase in height along two opposing directions extending laterally inwardly toward the central portion of the back panel, such that the back panel has a graduated venting profile corresponding to the graduated lateral profile of the plurality of lines of stitching, the graduated venting profile including increased venting at the central portion and decreased venting away from the central portion.

12. The item of outerwear of claim 11 wherein the plurality of insulation baffles and the plurality of vent baffles are arranged in an alternating pattern.

13. The item of outerwear of claim 12 wherein the plurality of insulation baffles each decrease in height toward the central portion.

14. The item of outerwear of claim 11 wherein each adjacent pair of the lines of stitching defines one of the plurality of insulation baffles or one of the plurality of vent baffles.

15. The item of outerwear of claim 14 wherein each adjacent pair of the lines of stitching undulates toward or away from one another toward the central portion of the back panel.

16. The item of outerwear of claim 15 wherein the insulation baffles and the vent baffles alternate in a regular repeating pattern over the entire height of the back panel.

17. The item of outerwear of claim 11 wherein:

the plurality of insulation baffles and the plurality of vent baffles alternate in a regular repeating pattern over the entire height of the back panel; and the plurality of insulation baffles each increase in height along two opposing directions extending laterally outwardly from the central portion of the back panel, with the plurality of vent baffles each concurrently decreasing in height along the two opposing directions extending laterally outwardly from the central portion of the back panel.

* * * * *